United States Patent [19]

Palac

[11] Patent Number: 4,593,224

[45] Date of Patent: Jun. 3, 1986

[54] TENSION MASK CATHODE RAY TUBE

[75] Inventor: Kazimir Palac, Carpentersville, Ill.

[73] Assignee: Zenith Electronics Corporation, Glenview, Ill.

[21] Appl. No.: 538,001

[22] Filed: Sep. 30, 1983

[51] Int. Cl.[4] ..... H01J 29/06; H01J 29/24

[52] U.S. Cl. ..... 313/402; 313/403; 313/407; 313/408; 313/482

[58] Field of Search ..... 313/402, 403, 407, 408, 313/415, 482

[56] References Cited

U.S. PATENT DOCUMENTS

| | | | |
|---|---|---|---|
| 2,625,734 | 1/1953 | Law | 29/25.13 |
| 2,761,990 | 9/1956 | Amdursky et al. | 313/83 |
| 2,813,213 | 11/1957 | Cramer et al. | 313/78 |
| 2,842,696 | 7/1958 | Fischer-Colbrie | 313/78 |
| 2,897,392 | 7/1959 | Fiore | 313/408 |
| 2,905,845 | 9/1959 | Vincent | 313/78 |
| 3,284,655 | 11/1966 | Oess | 313/286 |
| 3,440,469 | 5/1969 | Bradu et al. | 313/89 |
| 3,489,966 | 1/1970 | Bradu et al. | 313/83 |
| 3,638,063 | 1/1972 | Tachikawa et al. | 313/348 |
| 3,719,848 | 3/1973 | Bradu | 313/85 S |
| 3,873,874 | 3/1975 | Shimal | 313/402 |
| 3,894,321 | 7/1975 | Moore | 313/402 X |
| 4,069,567 | 1/1978 | Schwartz | 29/447 X |

FOREIGN PATENT DOCUMENTS

| | | | |
|---|---|---|---|
| 46-23981 | of 0000 | Japan . | |
| 56-141148 | 11/1981 | Japan . | |
| 165327 | 4/1971 | Netherlands | 313/407 |
| 1163495 | 6/1967 | United Kingdom . | |

OTHER PUBLICATIONS

"Improvements in the RCA Three-Beam Shadow--Mask Color Kinescope," Puc. IRE, 1954, R583.6X535.6 pp. 315-325.

*Primary Examiner*—Arthur Kellogg

*Attorney, Agent, or Firm*—Cornelius J. O'Connor; John H. Coult; Ralph E. Clarke, Jr.

[57] ABSTRACT

A color cathode ray tube comprises a faceplate having a predetermined pattern of phosphor deposits upon a target surface thereof. A color selection electrode assembly includes a frame which supports in tension a foil having an array of apertures related to the predetermined pattern of phosphor deposits on the faceplate. Means are disclosed for sealing the assembly between the faceplate and the rear envelope section of the tube to incorporate the color selection electrode assembly as an integral part of the cathode ray tube. Indexing means on the assembly and faceplate provide for repeated interregistered matings of the color selection electrode assembly with the faceplate. A method of utilizing the electrode assembly for screening the pattern of phosphor deposits on the faceplate is also disclosed.

27 Claims, 5 Drawing Figures

Fig. 1
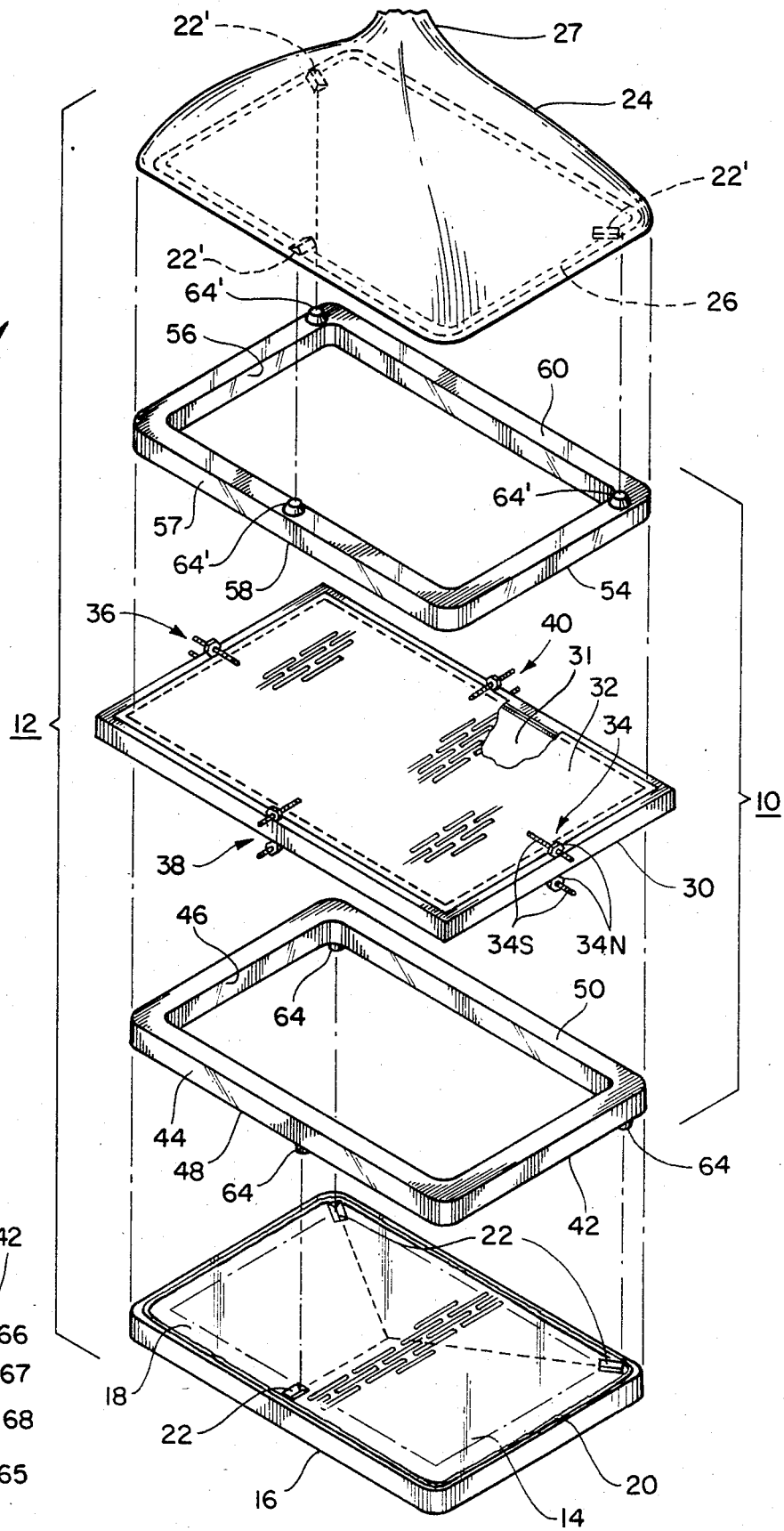
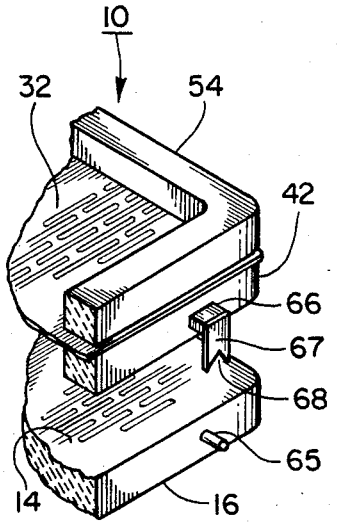
Fig. 5

TENSION MASK CATHODE RAY TUBE

BACKGROUND OF THE INVENTION

This invention relates in general to a color cathode ray tube having a flat faceplate and to a color selection electrode assembly for use therein. Of equal significance, the invention is concerned with methods of manufacturing the electrode assembly, as well as a cathode ray tube utilizing the assembly.

In general, a color selection electrode or "shadow mask" is a device which is disposed adjacent the luminescent phosphor screen that forms the target electrode of a color cathode ray tube, to control the landing pattern of one or more electron beams as they are swept across the screen. The shadow mask achieves color selection by partially shadowing the surface of the screen from scanning electron beams, permitting access to selected elemental phosphor areas by those beams. The choice of a color selection electrode for use in color television cathode ray tubes is, by and large, a choice between a spherical or bi-radial electrode and a cylindrical electrode tensed upon a heavy spring frame—both types being supported within the tube envelope. The most common type of color selection electrode used in color television receivers today is the conventional curved (non-tensed) type.

In color picture tubes utilizing a conventional shadow mask, there is a tendency on the part of the mask to "dome" (localized buckling) in those areas where a scene characterized by very high brightness is depicted. For example, in a scene where a high concentration of white is presented for an extended period of time, when the beams sweep that area of the screen the current in each beam peaks precipitously with an attendant localized heating of the mask. As a result of such a concentration of heat, that area of the mask expands and displaces itself from its original "cold" position to a position in which it does not effect proper masking of the writing electron beams. As a result, color purity is degraded. Moreover, because of its vulnerability to "doming", a conventional mask cannot accommodate the power density that a "doming-resistant" tensed mask can.

The general practice in cathode ray tubes manufactured for use in color television receivers is to position the mask at an assigned location, relative to the phosphor screen, by suspending it from three preselected points disposed about the periphery of the tube's face panel. This suspension accommodates overall thermal expansion of the mask by causing the mask to be displaced toward the screen from its original position by provision of bi-metallic support springs; however, such provision can not resolve the above-described localized "doming" problem caused by concentrated heating in localized areas of the mask.

Insofar as the use of a tensioned color selection electrode is concerned, the most common use of such an electrode has been in connection with the cylindrical faceplate CRT produced by one color television manufacturer. In that tube, the color selection electrode comprises a grid formed of a multitude of parallel conductors tensed across a rigid spring frame suspended conventionally within the tube. This grid serves to mask the writing beam(s) to fall upon the desired light emitting phosphor.

The mask supporting frame is mechanically stressed, as by compressing it, prior to attaching the shadow mask thereto. Upon release of the compression force, restoration forces in the frame establish tension in the mask.

An advantage of utilizing a tensed mask resides in the fact that the mask, while under tension, will not "dome". The mask retains its desired configuration during normal operating conditions.

Under extreme tube operating conditions, however, electron bombardment of a tensed mask can cause a series of grids of the mask to relax and cause color impurities. A cathode ray tube utilizing a tensed mask of the type adverted to above, the Sony Trinitron, is described in U.S. Pat. No. 3,638,063.

The color television cathode ray tube in most common usage today employs a faceplate which approximates a section of a large radius sphere. The shadow mask in such a tube, is contoured to match the faceplate. A trend today is toward a flatter faceplate which, in turn, calls for a flatter shadow mask. However, a fatter mask is inherently less mechanically stable than a more curved mask. Accordingly, to acquire mechanical stability, resort is had to a thicker mask, for example, one having a thickness in the order of 10 to 12 mils. This is approximately twice the thickness of a conventional curved mask. However, when one goes to a 10 to 12 mil mask, the aperture etching process is much more difficult. Specifically, in order to prevent aperture limiting of the beam at the outer reaches of the mask, as would be encountered in a 90 degree tube, the apertures have to be etched at an angle to the plane of the mask, rather than etched more perpendicular to that plane as is the case for a conventional curved mask.

DISCUSSION OF OTHER PRIOR ART

An early example of a tensed shadow mask for use in a color television cathode ray tube is described in U.S. Pat. No. 2,625,734. The tensed mask described therein was created by resort to a process called "hot-blocking". The practice was to insert a flat mask between a pair of frames which loosely received the mask. A series of tapped screws joining the two frames served to captivate the mask when the screws were subsequently drawn-down. The loosely assembled frame and mask was then subjected to a heat cycle by positioning heated platens adjacent the mask to heat and thereby expand it. The frame, however, was kept at room temperature. When the mask attained a desired expansion, the frame screws were tightened to captivate the mask in its expanded state. The heating platens were then removed. Upon cooling down to room temperature, the mask was maintained under tension by the frame. The resultant assembly was then mounted inside the tube adjacent the phosphor screen.

U.S. Pat. No. 3,284,655—Oess is concerned with a direct viewing storage cathode ray tube employing a mesh storage target which is supported in a plane perpendicular to the axis of the tube. The mesh target comprises a storage surface capable of retaining a charge pattern which, in turn, controls the passage therethrough of a stream of electrons. From a structural standpoint, it is proposed that mesh storage screen be affixed (no details given) to a circumferential ring that is disposed across the open end of envelope member. One end of the ring is in contact with the edge of the envelope member which has a coating of glass frit applied thereon. The end wall of another envelope member, also coated with frit, is placed in contact with the other side of the ring so that the end walls of the envelope members now abut both sides of the ring. Thereafter this assembly is frit sealed to secure the ring and mesh target within the tube.

It is of particular significance that the electrode spanning the inside of the tube envelope is a mesh screen that is not said to be subject to tension forces. Moreover, the mesh screen is not a color selection electrode that serves to direct a writing beam to selected elemental areas of color phosphors. Finally, there is no criticality, perceived or discussed, as respects mesh target registration with the phosphor layer on the faceplate.

U.S. Pat. No. 2,813,213 describes a cathode ray tube which employs a switching grid mounted adjacent the phosphor screen to provide a post deflection beam deflecting force. Basically, it is proposed to employ a taut wire grid that is sealed in the tube envelope wall and which, in one embodiment, proposes the use of an external frame to relieve the tension forces applied by the taut grid to the glass wall of the tube. In another embodiment, which is not pictorially disclosed but simply textually referred to, an arrangement is proposed comprising a glass donut-shaped structure into which the grid wires are sealed. This donut assembly is then inserted between the faceplate of the tube and its conical section. Thereafter, the patent notes, after the tube is assembled, the phosphors may be deposited on the faceplate by conventional photographic processes. The application of elemental color phosphor areas to the faceplate of a tube is, in itself, a formidable task; how this could be achieved with a grid structure in situ across the faceplate is dismissed perfunctorily. As will be developed herein, the subject invention teaches, inter alia, how an initially untensed shadow mask can be utilized to screen color phosphors on the faceplate of a color television tube.

U.S. Pat. No. 3,894,321, of common ownership herewith, is directed to a method for processing a color cathode ray tube having a thin foil mask sealed directly to the bulb. Included in this disclosure is a description of the sealing of a foil mask between the juncture of the skirt of the faceplate and the funnel. The foil mask is noted as having a greater thermal coefficient of expansion than the glass to which it is mounted, hence following a heating and cooling cycle in which the mask is cemented at the funnel-faceplate juncture, the greater shrinkage of the mask upon cooling places it under tension. The mask is shown as having two or more alignment holes near the corners of the mask which mate with alignment nipples in the faceplate. The nipples pass through the alignment holes to fit into recesses in the funnel. In another embodiment, the front panel is shown as having an inner ledge forming a continuous path around the tube, the top surface of which is a Q-distance away from the faceplate for receiving the foil mask such that the mask is sealed within the tube envelope. An embodiment is also shown in which the faceplate is skirtless and essentially flat.

Other examples of the prior art practice of utilizing a tensioned grid-type structure in a cathode ray tube environment are described in the following U.S. Pat. Nos.: 2,842,696, 2,905,845, 3,489,966, and 3,719,848, as well as Re 23,135; 1,163,495 (GB); 2,761,990; 3,440,469; 3,638,063; 3,873,874; 3,894,321; 4,069,567; and 4,495,473.

Finally, and by way of emphasizing the extent to which the invention to be described departs from the prior art, attention is directed to U.S. Pat. No. 3,898,508 which shows and describes a faceplate and shadow mask (untensed) assembly representative of current practice.

OBJECTS OF THE INVENTION

Accordingly, it is a general object of the invention to provide an improved color cathode ray tube color selection electrode arrangement for use in a color cathode ray tube.

It is another general object of the invention to provide a method of making an improved color selection electrode.

It is a further object of the invention to provide a color television picture tube which, in utilizing the improved color selection electrode arrangement, offers significant economic advantages over prior art tubes.

It is also an object of the invention to provide a method of manufacturing a color television cathode ray tube which, in utilizing the improved color selection electrode, effects substantial economies over prior manufacturing practices.

It is an object of the invention to provide a color selection electrode of the tensed type which has the anti-doming attribute of tension-type electrodes, but without the power handling limitations of prior art tension electrode systems.

It is still another object of the invention to provide an envelope-captivated tensed color selection electrode system having the advantages of such systems, yet which is readily photoscreened.

BRIEF DESCRIPTION OF THE DRAWINGS

FIG. 1 is an exploded view, in perspective, of the principal components of a color cathode ray tube embodying the invention;

FIG. 5 is a fragmentary sectional view of a portion of CRT faceplate and a color selection electrode assembly depicting an alternative faceplate/color selection electrode registration arrangement.

DESCRIPTION OF A PREFERRED EMBODIMENT

Figure 2:
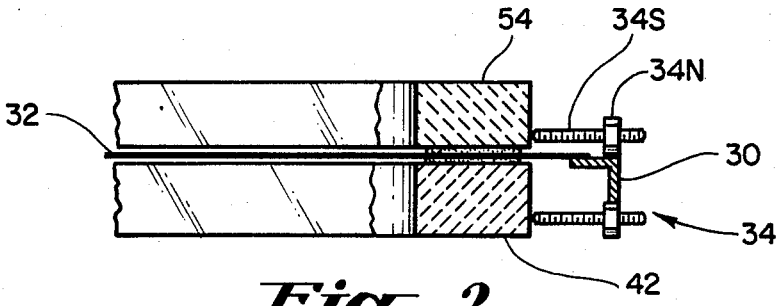
FIG. 2 is a fragmented sectional view of the electrode assembly shown in FIG. 1, in which components of that electrode are partially assembled.
Figure 3:
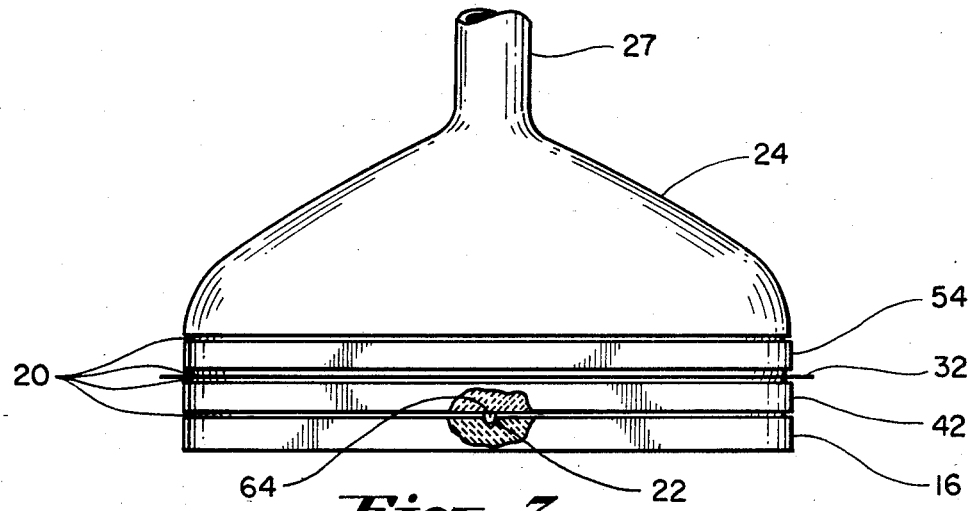
FIG. 3 is an elevational view of a partially assembled version of the tube shown in FIG. 1.

A color selection electrode assembly 10 constructed in accordance with a preferred embodiment of the invention, is shown in FIG. 1 associated with and forming an integral part of a color television cathode ray tube 12. Tube 12 is depicted therein in a perspective exploded format as an aid in visualizing the inventive concept. As will be described, electrode assembly 10 is utilizable as a stencil for use in screening a pattern of luminescent primary color elemental phosphor areas upon the target surface 14 of the envelope section 16 that comprises the faceplate of tube 12. In the disclosed embodiment, faceplate 16 is depicted as a flat panel of glass preferably formed from sheet glass so as to take advantage of material substantially less expensive than a conventional glass face panel. The flat glass faceplate has a predetermined temperature coefficient of expansion and has a sealing land 18 that circumscribes target surface 14. This sealing land, constitutes a surface for receiving a bead of frit 20, a devitrifying glass adhesive employed in fabricating cathode ray tubes. Preferably, the frit employed is a low-temperature solder glass material which is available from Owens-Illinois Inc. under their designation CV-130.

In any event, as will be shown, the electrode assembly 10, upon completion of its screening function, is thereafter, at the option of the practitioner, frit sealable to faceplate 16 to permit selective excitation of the primary color phosphors by a scanning electron beam(s) when that assembly forms a constituent of a color cathode ray tube. To this end, faceplate 16 is provided with registration affording means or alignment elements, which take the form of a plurality of V-grooves 22; in this execution they constitute three slots which are milled into the surface of the faceplate's sealing land 18. Preferably, the included angle defined by the sloping walls of grooves 22 approximate sixty degrees and they are oriented so that the bottom of each groove lies along a line that extends radially from the geometric center of the faceplate.

Moreover, it is of particular significance that V-grooves 22 do not extend to the edge of the faceplate, see FIG. 1. The depicted construction is resorted to in order to avoid a direct communication to the outside world which could compromise vacuum integrity once the faceplate has been frit sealed to electrode assembly 10 and to a funnel 24. While discernible only in phantom in FIG. 1, funnel 24 has a sealing land 26 which geometrically matches a mating surface of one component of electrode assembly 10, the composition of which is described in detail below. If desired, funnel sealing land 26 may be provided with a corresponding plurality of alignment elements which also take the form of V-grooves 22' milled into sealing land 26 and which can be spatially aligned with indexing means associated with the aforesaid one component of electrode assembly 10. Recourse to V-grooves 22' is optional since it is appreciated that other means for aligning the funnel sealing land 26 with electrode assembly 10 are well known. In fact, a common practice is to use an "outside" reference system, which, for the case at hand, would entail aligning the funnel to the electrode assembly, after that assembly had been mated to the faceplate, by positioning the funnel against referencing snubbers. For sealing purposes, which will be described, either funnel land 26 or the upper sealing land surface of electrode assembly 10 is provided with a bead of devitrifying frit. Finally, funnel 24, which includes a neck 27, is formed of a material, e.g., a glass or ceramic composition which, preferably has the same, or approximately the same, temperature coefficient of expansion as faceplate 16.

The color selection electrode arrangement 10 shown in FIG. 1 comprises a temporary severable mount 30 defining a central opening 31 of a predetermined expanse. Mount 30, which adopts a rectangular configuration, is readily formed from four butt-welded strips of L-shaped angle metal. Strips of other geometry, of course, are also suitable. In any case, the four-sided mount is formed of a material having a temperature coefficient of expansion greater than that of envelope sections 16 and 24. Thus, mount 30 can be formed from cold rolled steel, stainless steel, nickel or monel to name a few of the materials found acceptable in practicing the invention.

Electrode assembly 10 further comprises, at this stage, an untensed planar foil 32 which has a predetermined array, or pattern, of apertures which may be triads of minute circular holes or, as now favored in state of the art color television tubes, a myriad of elongated narrow slots disposed perpendicular to the major axis of the foil. The foil is tautly drawn across opening 31 of the mount under whatever tension is required to render the foil planar and it is then secured to the four sides of mount 30 by brazing or welding. In a manner to be described, foil 32 will subsequently be converted to a tension mask. Foil 32 has a temperature coefficient of expansion which is not greater than that of mount 30 and, preferably, a temperature coefficient less than that of the mount. Thus, foil 32 can be formed from cold rolled steel, or invar, to name two substances, each of which are utilizable with mounts made from any of the above-mentioned mount materials.

Desirably, the thickness of foil 32 is preferably less than 2 mils (0.002 in.), otherwise unacceptable stresses may be induced in envelope glass when the foil, under tension, is incorporated in a tube. Preferably, a foil having a thickness equal to or less than 1 mil (001 in.) is most suitable in practicing the invention. In fact, when resort to electro-forming of foils is had, foils having a thickness of one-half mil (0.005 in.) or less are realizable and find practical application in the practice of the invention. For purposes which will soon be apparent, mount 30 is provided with a plurality of adjustable positioning devices. More particularly, four identical sets 34, 36, 38 and 40 of such devices are deployed around the mount with one set centered, approximately, upon each side of the mount. In this fashion, and as shown in FIG. 1, set 34 is disposed opposite set 36 while set 38 is opposite set 40. Since the sets of positioning devices are identical, only set 34 need be detailed. Accordingly, this set comprises a pair of inwardly directed threaded spindles **34*s* each of which is rotatably received in a conventional nut 34*n* for displacement along an axis perpendicular to the central axis of tube 12. One nut is secured, as by welding or brazing, to the upper surface, as viewed in FIG. 1, of its assigned mount side while the other is secured to the underside of the depending wall of that side, see also FIG. 2**.

In order to establish a permanent support for foil 32, electrode assembly 10 includes a first frame means comprising a substantially rectangular frame member 42 which has an overall span that is less than the expanse of central opening 31 in mount 30. In other words, the outside dimensions of frame member 42 are such as to permit the frame to be received within central opening 31 of mount 30. In practice, frame 42 is nested inside opening 31 of the mount with its outer bounding wall 44 abutting against the ends of the lower spindles of positioning devices 34, 36, 38 and 40. First frame member 42 defines a central aperture 46 which is dimensioned to enclose, or frame, target surface 14 of faceplate 16. Frame 42 is formed of a glass or ceramic material having a temperature coefficient of expansion approximating that of faceplate 16 and, if formed from glass, is desirably cut from the same type of sheet glass as that utilized for the faceplate. In the central axial direction, as viewed in FIG. 1, frame 42 is bounded by a pair of substantially flat, spaced-apart, parallel surfaces 48, 50 which comprise sealing lands that circumscribe aperture 46. The distance between surfaces 48, 50, in other words, the axial thickness of frame 42, is partially determinative of the Q-spacing for the cathode ray tube in which electrode assembly 10 is subsequently incorporated. Q-spacing is defined as the spacing between the luminescent screen of a cathode ray tube and its shadow mask, in this case, it is the spacing between target surface 14 and foil 32.

By way of further support for foil 32, electrode assembly 10 includes a second frame means comprising a substantially rectangular frame member 54 having an overall span that conforms substantially to the span of first frame member 42 and has a central aperture 56 substantially conforming, in expanse, to aperture 46 of frame 42. Frame 54 is also nestable within opening 31 of mount 30 with its aperture coaxially aligned with aperture 46 of frame 42 and with its outer bounding wall 57 abutting against the ends of the upper spindles of the mount supported positioning devices. The function of these adjustable positioning devices is now apparent; they serve to accurately align frame members 42 and 54 so that their respective apertures are coaxial as well as to retain them in mount 30 for the subsequently to be described fabrication of the tensed color selection electrode assembly 10.

Frame 54, preferably, is formed from the same type of material as that utilized for frame member 42 and thus has a temperature coefficient of expansion approximating that of faceplate 16. Frame 54 is also bounded by a pair of substantially flat, spaced-apart parallel surfaces 58, 60 that constitute sealing lands that circumscribe aperture 56 of this frame.

With frame members 42 and 54 supported in the manner shown and described, sealing land 58 of frame 54 is disposed in a confronting relation to sealing land 50 of frame 42 and with the periphery of foil 32 sandwiched therebetween. Specifically, foil 32 presents the upper side of a peripheral portion thereof to sealing land 58 of frame 54 and, at the same time, presents the lower or opposite side of that peripheral portion to sealing land 50 of frame 42. As has been indicated, electrode assembly 10 is utilizable as a stencil for screening a pattern of elemental phospher areas upon target surface 14 of faceplate 16. Moreover, as can be appreciated, a precise and, as important, a repeatable, kinematic registration between assembly 10 and faceplate 16 is essential in order to utilize foil 32 as a stencil in screening such a pattern upon that target surface. By way of securing the required precise registration between electrode assembly 10 and faceplate 16, sealing land 48 of frame member 42 has indexing means associated therewith. More particularly, such means comprises a plurality (three) of rounded abutments, or bosses, 64 selectively located upon and affixed to sealing land 48 for cooperation with the registration affording grooves 22 milled into the surface of faceplate sealing land 18. The function of each of bosses 64 is to effect a two point contact with the groove it is received by, for a total six-point contact as between frame member 42 and faceplate 16. To that end, each boss adopts a geometry such that when it is seated upon the inclined walls of its assigned faceplate groove, the target surface of the faceplate and foil 32 are maintained in a predetermined spaced-apart relation, that is, the previously adverted to Q-spacing. It is thus seen that, in addition to the axial thickness of frame member 42, Q-spacing is also determined by the geometry of V-grooves 22 and bosses 64. It is appreciated, of course, that the registration format can be reversed, that is, sealing land 48 of frame 42 can be provided with grooves while the faceplate sealing land is fitted with boss elements. Since bosses 64 will ultimately be frit-sealed between the faceplate sealing land and sealing land 48 of frame member 42, it is desirable that they be formed from a glass sealable material, e.g. a metal alloy. An alloy particularly suited for this purpose is available from Carpenter Technology Corporation in Reading, Pa. under their designation 430TI.

If it is decided that a like registration arrangement is desired to align electrode assembly 10 with funnel 24, a plurality of boss elements 64' can be selectively located upon and affixed to sealing land 60 of frame member 54 for cooperation with grooves 22' milled into the funnel's sealing land 26.

On the other hand, an alternative registration arrangement for effecting a six-point contact between electrode assembly 10 and faceplate 16 contemplates the external approach shown in FIG. 5. More particularly, as a registration affording means the faceplate 16 is fitted with three (only one shown) externally mounted, outwardly directed, break-away pins 65 which, geometrically, adopt the same relative locations as those occupied by V-grooves 22 on the faceplate shown in FIG. 1. Indexing means cooperating with each of the pins 65 comprises a break-away 66 affixed to lower frame member 42. Tab 66 has a depending finger 67 which, in turn, is provided with a bifurcation 68 at its distal end. Accordingly, to effect a kinematic registration with this embodiment, electrode assembly 10 is supported over the faceplate with a finger bifurcation 68 poised over its assigned pin. When the assembly 10 is lowered, a six-point contact is established between the three pins 65 and their cooperating bifurcations 68. This registration between the electrode assembly and the faceplate is repeatable as often as is required to accomplish screening of the target surface 14 of the faceplate, as well as to effect a final registration between the electrode assembly and the faceplate prior to frit sealing. After the funnel and faceplate have been frit sealed to bond electrode assembly 10 between their confronting sealing lands (a process described below) pins 65 may be broken away from the faceplate and tabs 66 broken away from frame member 42. Moreover, it is appreciated that the physical locations of the pins and the bifurcated fingers can be reversed and that other indexing structure within the knowledge of one skilled in the art could be employed. Of course, a like external registration arrangement can be adopted, if desired, for aligning funnel 24 with the foil mount.

Now that the basic components of electrode assembly 10 have been described, attention is directed to the fabrication of a tensed color selection electrode. Referring specifically to the fragmented sectional view of FIG. 2, as well as FIG. 1, a bead 70 of frit is applied to sealing land 50 of frame 42 and permitted to dry. In this instance, as well as in any other frit application hereinafter resorted to, the previously mentioned Owens-Illinois type CV-130 is the preferred material. Another bead 72 of frit is applied to sealing land 58 of frame member 54 and is also permitted to dry. Mount 30, with foil 32 tautly secured thereto, is then positioned over frame 42 with the underside of the foil's peripheral portion in contact with frit bead 70. Frame member 54 is then nested into mount 30 with its frit bead 72 in contact with the upper side of the foil's peripheral portion. Positioning devices 34, 36, 38 and 40 are then adjusted to coaxially align apertures 46 and 56 of respective frame members 42 and 54. It is appreciated, of course, that the frit applications are a matter of choice since the beads of frit can be applied to the upper and lower peripheral portions of foil 32 instead of to sealing lands 50 and 58.

This assemblage is then inserted into a heat chamber, or oven, the temperature of which is elevated to approximately 430 degrees Centigrade and maintained thereat for thirty to forty-five minutes. These are the temperature and time parameters required to devitrify low-temperature CV-130 frit material. As the temperature rises frame members 42 and 54 will expand by an amount determined by their characteristic temperature coefficients of expansion. Simultaneously, mount 30 and foil 32 will also expand but, because of their greater temperature coefficients of expansion, their growth, relative to the frame members, will be greater. By the time this assemblage has reached a temperature of 430 degrees Centigrade, and by the time the frit has devitrified, mount 30 and foil 32 will have stabilized their expansion, as will have the frame members.

When the frit has devitrified, the periphery of foil 32 is captured therein between frame members 42 and 54. Thereafter, as the assemblage cools down to room temperature and the materials return, or attempt to return, to their normal dimensions, foil 32 wil be tensed by virtue of being captured within the frit junctions between the foil periphery and frame sealing lands 50 and 60, which junctions will prevent the foil from returning to its normal room temperature dimension. Thus the mask, which was "grown" by the heat attendant upon the frit sealing process, is trapped in tension and is so maintained thereafter by the devitrified frit bonding the frame members and the foil.

After the frame members and the foil have been frit bonded, mount 30 is removed from the captured foil by severing the foil along the inside perimeter of the mount. (The mount, of course, is reuseable.) The foil is then trimmed as close to the outside perimeter of the frame-foil junction as possible.

Figure 4:
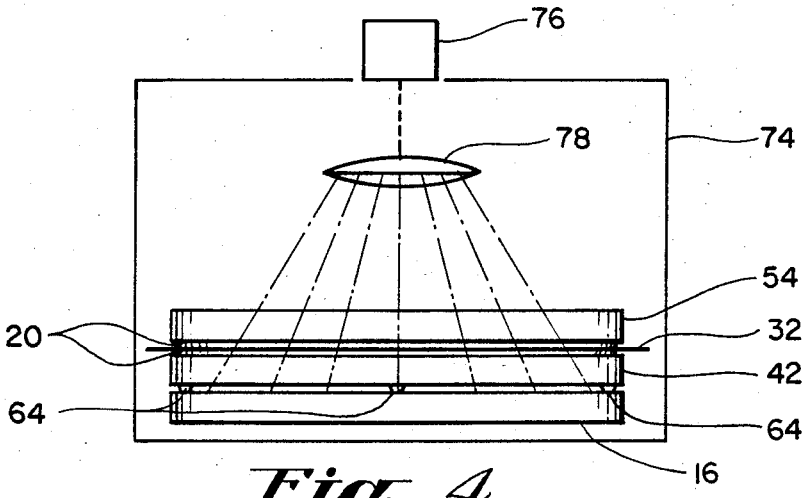
FIG. 4 is a schematic representation of a lighthouse arrangement for screening a cathode ray tube faceplate according to this invention.

There will now be described a process that utilizes electrode assembly 10 as a stencil, to screen a pattern of primary color elementary phosphor areas upon the target surface 14 of faceplate 16. A known and widely used method of preparing a color phosphor screen utilizes a process which has devolved from familiar photographic techniques. To this end, a slurry comprising a quantity of a primary color phosphor particles suspended in a photosensitive organic solution e.g., pva, is applied, as a coating, to the target surface 14 of faceplate 16. The now tensed electrode assembly 10 (sans mount 30) is then seated upon faceplate 16 by effecting a registration between bosses 64 and their assigned faceplate grooves 22. As schematically depicted in FIG. 4, the registered faceplate and electrode assembly is then inserted in a lighthouse 74 comprising a source of light 76 actinic to the photosensitive coating and a conventional beam trajectory compensating lens 78. This lens serves to compensate for the fact that the trajectory of an electron beam, under deflection, differs from the path of a light ray originating from the same point source as the electron beam. At any one instant light source 76 occupies a spatial position corresponding, in effect, to the axial position of the source of the electron beam that will subsequently excite the phosphor pattern to be created. The slurry coating is then exposed to the actinic light rays that pass through compensating lens 78 before encountering the foil apertures. The light transmitted through foil 32 then creates a latent image of the foil's aperture pattern on the coated faceplate.

Accordingly, after the initial exposure through lens 78, electrode assembly 10 is then removed and the substrate is washed. By way of example, in a positive resist, positive guardband system, this wash will remove the exposed portion of the coating. However, it is to be appreciated that the invention is equally utilizable in a negative resist, negative guardband system or even in the tacky-dot dusting system. In any event, the exposed coating is processed to establish upon target surface 14 a pattern of elemental phosphor areas corresponding to the aperture pattern of foil 32.

The slurry coating, faceplate-electrode assembly registration, exposure and wash steps are then repeated for each of the other primary color phosphor areas to be applied to target surface 14, with the source of actinic light, of course, disposed at appropriately different positions with respect to assembly 10. A similar slurry coating, registration, exposure and wash procedure can be employed to provide the target surface with a black matrix pattern of the type employed in a negative guardband tube. The resultant luminescent screen comprises a pattern of interleaved primary color phosphor areas corresponding to the aperture pattern in foil 32. In practice, successive repositioning of the light source, prior to exposing the target screen through the foil, is such as to effectively mimic the positions of three scanning electron beams issuing from a gun mount later to be fitted to the tube. In this regard, it should be noted that the resultant luminescent screen pattern will bear a unique geometric relationship, or orientation, to the light sources and, thereby, to the electron beam axes of the subsequently fitted electron gun mount.

After the screening process has been completed, desirably, the electrode assembly 10 employed to pattern the screen is mated to faceplate 16 and to funnel 24. In this process, the upwardly facing sealing land surface 18 of faceplate 16 and the downwardly facing land surface 26 of funnel 24 are coated with beads of low-temperature frit which are permitted to dry. Again, the frit applications are a matter of choice since the beads of frit could as well be applied to first frame sealing land 48 and to second frame sealing land 60 instead of to surfaces 18 and 26. Assembly 10 is then re-registered with faceplate 16 by inserting bosses 64 into grooves 22. The sealing land of funnel 24 is then fitted over assembly 10 with its V-grooves 22' receiving bosses 64'. This assemblage is then inserted into the heat chamber the temperature of which is again elevated to approximately 430 degrees Centigrade and maintained thereat for thirty to forty-five minutes. These are the temperature and time parameters required to devitrify low-temperature Owens-Illinois type CV-130 frit material. After this assemblage has reached a temperature of 430 degrees Centigrade and after a suitable period of time at this temperature, the frit will have devitrified and electrode assembly 10 will be captured between funnel 24 and the faceplate 16 to form an integral part of cathode ray tube 12. Thereafter, when the assemblage cools down to room temperature and the materials return to their normal dimensions, foil 32 will remain tensed by virtue of its prior capturing by the frit junction bonding frame member 42 to frame member 54 along their confronting respective sealing lands 50, 58. Thus the foil, which was tensed, by the heat attendant upon the frit sealing process employed to fabricate electrode assembly 10, is trapped in tension and maintained thereafter by the devitrified frit joining the frame members 42 and 54.

After the faceplate-electrode-assembly-funnel assemblage has been frit sealed and a neck section fitted thereto, the tube is subjected to an exhaust process. The frame-foil junction of electrode 10 is then covered with a coating of insulating material 51 to prevent external contact with the foil which, depending upon the excitation system utilized with the completed tube, may be maintained at a high electrical potential.

It is to be noted that the alignment elements utilized by the faceplate and funnel, as well as the indexing means used for the frame members need not be restricted to the groove and boss format disclosed. Moreover, materials other than those disclosed for the envelope sections the frame members and the mount and foil can be used so long as the coefficients of expansions of such materials provide the differential expansion required to tense an initially untensed planar foil.

While particular embodiments of the invention have been shown and described, it will be obvious to those skilled in the art that changes and modifications may be made without departing from the invention in its broader aspects and, therefore, the aim of the appended claims is to cover all such changes and modifications as fall within the true spirit and scope of the invention.

I claim:

1. A tensed color selection electrode assembly utilizable for screening a pattern of luminescent primary color elemental phosphor areas upon the target surface of an envelope section of a color cathode ray tube, and which is adapted to being frit sealed between said envelope section and a funnel section of said tube to permit selective excitation of said primary color phosphor areas by a scanning electron beam, said envelope section having a sealing land and having registration affording means associated therewith and being formed of a material having a predetermined temperature coefficient of expansion, said electrode assembly comprising:

separate first frame means defining a central opening dimensioned to enclose said target surface of said envelope section;

said first frame means being formed of a material having a temperature coefficient of expansion approximating that of said envelope section and comprising a pair of substantially flat, spaced-apart surfaces constituting sealing lands;

separate second frame means defining a central opening of a span substantially conforming to that of said first frame means, formed of a material having a temperature coefficient of expansion approximating that of said envelope section and also comprising a pair of substantially flat, spaced-apart surfaces constituting sealing lands, one of said second frame means sealing lands being disposed in a confronting relation to one of said first frame means sealing lands;

a planar tensed foil, having a predetermined pattern of apertures, presenting one side of a peripheral portion thereof to said one sealing land of said first frame means and presenting the opposite side of said peripheral portion to said one sealing land of said second frame means, indexing means associated with the other of said first frame means sealing lands and cooperable with said envelope section registration affording means to permit precise registration between said apertured foil and said envelope section; and cementing means disposed between said confronting sealing lands of said first and second frame means and in intimate contact with said peripheral portion of said foil presented to said confronting sealing lands, for bonding said first frame means to said second frame means for capturing said foil therebetween and for maintaining said foil in tension.

2. A color selection electrode assembly as set forth in claim 1 in which said foil is formed of cold rolled steel.

3. A color selection electrode assembly as set forth in claim 1 in which said foil is formed of invar.

4. A color selection electrode assembly as set forth in claim 1 in which said foil is formed from cold rolled steel having a thickness in the range of 0.0005–0.002 inches.

5. A color selection electrode assembly as set forth in claim 1 in which said indexing means comprises a plurality of rounded abutments affixed to said other of said first frame means sealing lands and cooperably receivable by said registration affording means of said envelope section to effect said precise registration.

6. A color selection electrode assembly as set forth in claim 1 in which said spaced-apart sealing land surfaces for each said frame means are parallel.

7. A color selection electrode assembly utilizable for screening a pattern of luminescent primary color elemental phosphor areas upon the target surface of an envelope section of a color cathode ray tube, and which is adapted to being frit sealed between said envelope section and a funnel section of said tube to permit selective excitation of said primary color phosphor areas by a scanning electron beam, said envelope section having a sealing land and having registration affording means thereon and being formed of a material having a predetermined temperature coefficient of expansion, said electrode assembly comprising:

a temporary severable mount defining a central opening of predetermined expanse and formed of a material having a temperature coefficient of expansion greater than that of said envelope section;

a first frame member having an overall span which is less than said mount opening and defining a central aperture dimensioned to enclose said target surface of said envelope section, said first frame member being formed of a material having a temperature coefficient of expansion approximating that of said envelope section and comprising a pair of substantially flat, spaced-apart surfaces comprising sealing lands;

a second frame member having an overall span substantially conforming to that of said first frame member and defining a central aperture substantially conforming to that of said first frame member, formed of a material having a temperature coefficient of expansion approximating that of said envelope section and also comprising a pair of substantially flat, spaced-apart surfaces comprising sealing lands, one of said second frame sealing lands being disposed in a confronting relation to one of said first frame member sealing lands;

a planar foil, having a predetermined pattern of apertures, tautly secured to said mount and presenting one side of its peripheral edge portion to said one sealing land of said first frame member and presenting the opposite side of said peripheral edge portion to said one sealing land of said second frame member, said foil being formed of a material having a temperature coefficient of expansion not greater than that of said mount;

indexing means associated with the other of said first frame member sealing lands and cooperable with said envelope section registration affording means to permit precise registration between said apertured foil and said envelope section; and devitrifying frit means disposed between said confronting ones of said sealing lands of said first and second frame members and said peripheral edge portions of said foil presented to said confronting sealing lands, for capturing said foil therebetween.

8. A color selection electrode assembly as set forth in claim 7 in which said foil is secured to said mount by weld means.

9. A color selection electrode assembly as set forth in claim 7 in which said foil is secured to said mount by braze means.

10. A color selection electrode assembly as set forth in claim 7 in which said mount is formed of stanless steel and said foil is formed of cold rolled steel.

11. A color selection electrode assembly as set forth in claim 7 in which said mount includes a plurality of adjustable positioning devices engageable with said frame members for coaxially aligning said frame members.

12. A color selection electrode assembly as set forth in claim 11 in which said positioning devices comprise threadably mounted spindles.

13. A tensed color selection electrode assembly utilizable for screening a pattern of luminescent primary color elemental phosphor areas upon the target surface of an envelope section of a color cathode ray tube, and which is thereafter, optionally, frit sealable between said envelope section and a funnel section of said tube to permit selective excitation of said primary color phosphor areas by a scanning electron beam, said envelope section having a sealing land and having registration affording means thereon and being formed of a material having a predetermined temperature coefficient of expansion, said electrode assembly comprising:

a temporary severable mount defining a central opening of predetermined expanse and formed of a material having a temperature coefficient of expansion greater than that of said envelope section;

a first frame member having an overall span which is less than said mount opening and defining a central aperture dimensioned to enclose said target surface of said envelope section, said first member being formed of a material having a temperature coefficient of expansion approximating that of said envelope section and comprising a pair of substantially flat, spaced-apart surfaces comprising sealing lands;

a second frame member having an overall span substantially conforming to that of said first frame member and defining a central aperture substantially conforming to that of said first frame member, said second frame member being formed of a material having a temperature coefficient of expansion approximating that of said envelope section and also comprising a pair of substantially flat, spaced-apart surfaes comprising sealing lands, one of said second frame sealing lands being disposed in a confronting relation to one of said first frame member sealing lands;

a planar tensed foil, having a predetermined pattern of apertures, secured to said mount and presenting one side of its peripheral edge portion to said one sealing land of said first frame member and presenting the opposite side of said peripheral edge portion to said one sealing land of said second frame member, said foil being formed of a material having a temperature coefficient of expansion not greater than that of said mount;

indexing means, associated with the other of said first frame member sealing lands and cooperable with said envelope section registration affording means to permit precise registration between said apertured foil and said envelope section; and devitrifying frit means disposed between said confronting ones of said sealing lands of said first and second frame members and said peripheral edge portions of said foil presented to said confronting sealing lands, for capturing said foil therebetween and for maintaining said foil in tension.

14. A color cathode ray tube component comprising:

an envelope section, formed of a material having a predetermined temperature coefficient of expansion, comprising;

a target surface having a pattern of luminescent elemental phosphor areas deposited thereon and a sealing land circumscribing said target surface, said sealing land having registration affording means selectively located and oriented thereon;

a color selection electrode, affording selection of said phosphor areas by a scanning beam of electrons, comprising:

a first frame member defining a central aperture dimensioned to enclose said target surface of said envelope section, said first frame member being formed of a material having a temperature coefficient of expansion approximating that of said envelope section and comprising a pair of substantially flat, spaced-apart parallel surfaces comprising sealing lands;

a second frame member defining a central opening of a span substantially conforming to that of said first frame member, formed of a material having a temperature coefficient of expansion approximating that of said envelope section and also comprising a pair of substantially flat, spaced-apart parallel sealing lands, a second frame member defining a central aperture of a span substantially conforming to the central aperture of said first frame member and coaxially aligned with said first frame member, formed of a material having a temperature coefficient of expansion approximating that of said envelope section and also comprising a pair of substantially flat, spaced-apart surfaces comprising sealing lands, one of said second frame sealing lands being disposed in a confronting relation to one of said first frame member sealing lands;

a planar tensed foil, having a predetermined pattern of color selection apertures, presenting one side of its peripheral edge portion to said one sealing land of said first frame member and presenting the opposite side of said peripheral edge portion to said one sealing land of said second frame member, said foil being formed of a material having a temperature coefficient of expansion greater than either of said frame members;

indexing means, associated with the other of said first frame member sealing lands and cooperable with said envelope section registration affording means to permit precise registration between said foil apertures and said elemental phosphor areas of said target surface; and devitrifying frit means disposed between said confronting sealing lands of said first and second frame members and said peripheral edge portions of said foil presented to said confronting sealing lands for capturing said foil therebetween and for maintaining said foil in tension.

15. A color cathode ray tube component as set forth in claim 14 in which said envelope section comprises a flat glass faceplate.

16. A color cathode ray tube component as set forth in claim 15 in which said first frame member has an axial thickness that establishes Q spacing, that is, the spacing between said target surface and said foil.

17. A color cathode ray tube comprising:

a funnel having a sealing land;

a flat faceplate comprising a target surface having a pattern of luminescent primary color elemental phosphor areas deposited thereon and a sealing land circumscribing said target surface, said faceplate having registration affording means selectively located and oriented thereon;

a color selection electrode assembly permitting selective excitation of said phosphor areas by a scanning beam of electrons comprising;

a first frame member defining a central opening dimensioned to enclose said target surface of said faceplate, said first member being formed of a material having a temperature coefficient of expansion approximating that of said faceplate and comprising a pair of substantially flat, spaced-apart surfaces comprising sealing lands, a second frame member defining a central opening of a span substantially conforming to that of said first frame member, formed of a material having a temperature coefficient of expansion approximating that of said faceplate and also comprising a pair of substantially flat, spaced-apart surfaces comprising sealing lands, one of said second frame sealing lands being disposed in a confronting relation to one of said first frame member sealing lands, a planar tensed foil, having a predetermined pattern of apertures, presenting one side of its peripheral portion to said one sealing land of said first frame member and presenting the opposite side of said peripheral portion to said one sealing land of said second frame member, indexing means associated with the other of said first frame member sealing lands and cooperable with said faceplate registration affording means to permit precise registration between said apertured foil and said faceplate; and devitrifying frit means, disposed between said confronting sealing lands of said first and second frame members and in intimate contact with said sides of said peripheral portion of said foil presented to said confronting sealing lands, for bonding said first frame member to said second frame member, for capturing said foil therebetween and for maintaining said foil in tension, said frit means also disposed between said faceplate sealing land and said other of said first frame member sealing lands for bonding said faceplate to said color selection electrode, and further disposed between said funnel sealing land and the other of said second frame sealing lands for bonding said funnel to said color selection electrode.

18. A color cathode ray tube comprising:

a planar faceplate having a predetermined pattern of phosphor areas deposited upon a target surface thereof;

a rear envelope section;

a color selection electrode frame configured to mate with said rear envelope section and supporting a foil having an array of apertures therein related to said predetermined pattern of phosphor areas and maintaining said foil in tension in all directions in the plane of said foil, said electrode frame including Q-spacing means for spacing said foil a predetermined distance from the inner surface of said faceplate; and means cementing said color selection electrode frame between said faceplate and said rear envelope section to incorporate said color selection frame as an integral part of said cathode ray tube.

19. A color cathode ray tube as set forth in claim 18 in which said color selection electrode frame comprises a sandwich structure formed of a pair of frit sealed frame members capturing said foil about its periphery and maintaining said foil in tension.

20. A color selection electrode assembly for a color cathode ray tube having a planar glass faceplate, comprising frame means for supporting a foil color selection electrode in a tensed state in all directions in the plane of the foil electrode, said frame means being configured to mate with a rear section of the cathode ray tube envelope and having Q-spacing means embodied therein for separating said foil electrode from the inner surface of said faceplate and being adapted to be sealed integrally between the tube's faceplate and the rear section of the color cathode ray tube envelope such as to become an integral component of the envelope when sealed therein.

21. A three-beam color cathode ray tube having a planar faceplate with a pattern of discrete phosphor deposits thereon, said tube including a separate frame supporting a color selection electrode in a tensed state, said frame including Q-spacing means for spacing said electrode at a predetermined distance from said faceplate, said frame having substantially the same thermal coefficient of expansion as said faceplate and being cemented integrally to the faceplate so as to become a part of the envelope for the tube.

22. A color cathode ray tube comprising:

a faceplate having a predetermined pattern of phosphor areas deposited upon a target surface thereof;

a rear envelope section;

a color selection electrode assembly including a foil having an array of apertures therein related to said predetermined pattern of phosphor areas and a frame configured to mate with said rear envelope section for supporting said foil in tension;

means cementing said color selection electrode assembly between said faceplate and said rear envelope section to incorporate said color selection electrode assembly as an integral part of said cathode ray tube; and, indexing means upon said electrode assembly repeatably registrable with registration-affording means on said faceplate to permit repeated interregistered matings of the assembly with the faceplate.

23. A color cathode ray tube comprising:

a faceplate having a predetermined pattern of phosphor areas deposited upon a target surface thereof;

a rear envelope section;

a color selection electrode assembly including a foil having an array of apertures therein related to said predetermined pattern of phosphor areas and a frame configured to mate with said rear envelope section for supporting said foil in tension;

means cementing said color selection electrode assembly between said faceplate and said rear envelope section to incorporate said color selection electrode assembly as an integral part of said cathode ray tube; and, indexing means on said electrode assembly repeatably registrable with registration-affording means on said faceplate to permit repeated interregistered matings of the assembly with the faceplate, said indexing means and registration-affording means being located externally of the vacuum envelope of said tube.

24. The color cathode ray tube according to claim 23 wherein said externally located indexing means on said electrode assembly and said registration-affording means on said faceplate are removable from said tube.

25. The color cathode ray tube according to claim 24 wherein said externally located indexing means on said electrode assembly and said registration-affording means on said faceplate can be broken away from said tube.

26. A color cathode ray tube comprising:

a faceplate comprising a target surface having a pattern of luminescent primary color phosphor areas deposited thereon and a sealing area circumscribing said target surface, said faceplate sealing area having a plurality of registration-affording elements selectively located and oriented thereon;

a color selection electrode assembly comprising a frame supporting in tension a foil having a pattern of color selection apertures related to said pattern of phosphor areas for affording selection of said phosphor areas by a scanning beam of electrons;

indexing means on said frame and cooperable with said registration-affording elements in the sealing area of said faceplate for establishing precise registration between said foil apertures and said elemental phosphor areas of said target surface; and, sealing means for uniting said frame of said assembly with said faceplate and said indexing means with said registration-affording elements such that said color selection electrode assembly is incorporated as an integral part of said cathode ray tube.

27. A color cathode ray tube comprising:

a faceplate having a predetermined pattern of phosphor areas deposited upon a target surface thereof;

a rear envelope section;

a color selection electrode assembly comprising a pair of frames configured to mate with said rear envelope section between which is sandwiched a foil having an array of apertures therein related to said predetermined pattern of phosphor areas and maintaining said foil in tension, said assembly including insulating means engirdling said assembly such as to cover at least externally exposed portions of said foil; and, means cementing said color selection electrode assembly between said faceplate and said envelope section to incorporate said color selection electrode assembly as an integral part of said cathode ray tube.

* * * * *

Disclaimer 4,593,224.—*Kazimir Palac,* Carpentersville, Ill. TENSION MASK CATHODE RAY TUBE. Patent dated June 3, 1986. Disclaimer filed Nov. 24, 1986, by the assignee, *Zenith Electronics Corp.*

Hereby enters this disclaimer to claims 18, 20 and 21 of said patent.

[*Official Gazette February 3, 1987.*]